US008776903B2

(12) United States Patent
Jimenez et al.

(10) Patent No.: US 8,776,903 B2
(45) Date of Patent: Jul. 15, 2014

(54) LODGMENT PREVENTION ARRANGEMENTS FOR FIRE SPRINKLERS

(75) Inventors: Juan Jimenez, Liberty, SC (US); George S. Polan, Liberty, SC (US); John Tow, Liberty, SC (US); Myron Allen, Liberty, SC (US)

(73) Assignee: The Reliable Automatic Sprinkler Co., Inc., Liberty, SC (US)

( * ) Notice: Subject to any disclaimer, the term of this patent is extended or adjusted under 35 U.S.C. 154(b) by 687 days.

(21) Appl. No.: 13/014,680

(22) Filed: Jan. 26, 2011

(65) Prior Publication Data

US 2011/0180277 A1 Jul. 28, 2011

Related U.S. Application Data

(63) Continuation-in-part of application No. 11/848,103, filed on Aug. 30, 2007, now abandoned, which is a continuation of application No. 10/974,106, filed on Oct. 26, 2004, now Pat. No. 7,275,603.

(51) Int. Cl.

| | |
|---|---|
| ***A62C 37/08*** | (2006.01) |
| ***A62C 37/36*** | (2006.01) |
| ***A62C 37/12*** | (2006.01) |
| ***A62C 37/10*** | (2006.01) |
| ***A62C 37/11*** | (2006.01) |

(52) U.S. Cl.

CPC ..... *A62C 37/12* (2013.01); *A62C 37/10* (2013.01); *A62C 37/11* (2013.01)

USPC ..... 169/39; 169/37; 169/38; 169/41; 169/42

(58) Field of Classification Search

CPC ..... A62C 37/10; A62C 37/11; A62C 37/12

USPC ..... 169/37, 38, 39, 40, 41, 42, 57

See application file for complete search history.

(56) References Cited

U.S. PATENT DOCUMENTS

| | | | |
|---|---|---|---|
| 323,578 | A | 8/1885 | Harkness |
| 437,846 | A | 10/1890 | Kehr |

(Continued)

FOREIGN PATENT DOCUMENTS

| | | | |
|---|---|---|---|
| GB | 2155328 | 9/1985 | ..... A62C 37/09 |
| JP | 9187529 | 7/1997 | ..... A62C 35/58 |

OTHER PUBLICATIONS

International Search Report and Written Opinion of the International Searching Authority, mailed May 21, 2012 in International Patent Application No. PCT/US12/22777.

(Continued)

*Primary Examiner* — Ryan Reis

(74) *Attorney, Agent, or Firm* — Fitzpatrick, Cella, Harper & Scinto

(57) ABSTRACT

A fire protection sprinkler is provided. The sprinkler includes a body having an output orifice and a flange; a seal cap to seal a flow of fluid from the output orifice; and a thermally-responsive element positioned to releasably retain the seal cap and constructed to separate into a plurality of portions upon exposure to a predetermined temperature. The sprinkler also includes at least one deflector support member, a deflector connected to the deflector support member, and at least one arm extending from each of the deflector support members. Each of the arms has a free end positioned in spaced relation to the thermally-responsive element to contact the portions of the thermally-responsive element upon separation thereof. In another embodiment, the sprinkler includes at least one arm extending from the flange, and the arms may be formed as a bracket.

9 Claims, 12 Drawing Sheets

(56) References Cited

U.S. PATENT DOCUMENTS

| | | | | | |
|---|---|---|---|---|---|
| 590,978 | A | * | 10/1897 | Gschwind | 169/41 |
| 777,783 | A | * | 12/1904 | Garrett | 169/39 |
| 1,422,875 | A | | 7/1922 | Madigan | |
| 2,558,450 | A | | 6/1951 | Martin | |
| 3,714,989 | A | | 2/1973 | Gloeckler | |
| 4,014,388 | A | | 3/1977 | Anderson | 169/37 |
| 4,029,150 | A | | 6/1977 | Goodsell, Jr. | 169/39 |
| 4,105,076 | A | | 8/1978 | Simons et al. | 169/40 |
| 4,108,247 | A | * | 8/1978 | Mohler | 169/38 |
| 4,176,718 | A | | 12/1979 | Vorkapich | 169/39 |
| 4,403,661 | A | | 9/1983 | Tokar | 169/38 |
| 4,491,182 | A | | 1/1985 | Pieczykolan | 169/38 |
| 4,508,175 | A | | 4/1985 | Pieczykolan | 169/38 |
| H121 | H | | 9/1986 | Pieczykolan | |
| 4,618,002 | A | | 10/1986 | Mears | 169/37 |
| 4,664,198 | A | | 5/1987 | Johnson | |
| 4,715,447 | A | | 12/1987 | Johnson | 169/37 |
| 4,880,063 | A | * | 11/1989 | Leininger et al. | 169/37 |
| 4,926,946 | A | | 5/1990 | Polan | 169/37 |
| 4,938,292 | A | | 7/1990 | Johnson | 169/19 |
| 4,976,320 | A | | 12/1990 | Polan | 169/39 |
| 5,010,959 | A | | 4/1991 | Lostoski | 169/37 |
| 5,036,923 | A | | 8/1991 | Shea, Sr. | 169/37 |
| 5,080,176 | A | | 1/1992 | Polan et al. | 169/37 |
| 5,083,616 | A | | 1/1992 | Polan | 169/40 |
| 5,094,298 | A | | 3/1992 | Polan | 169/41 |
| 5,097,906 | A | | 3/1992 | Polan | 169/37 |
| 5,152,344 | A | | 10/1992 | Fischer et al. | 169/37 |
| 5,188,185 | A | | 2/1993 | Mears | 169/37 |
| 5,203,416 | A | | 4/1993 | Takeuchi et al. | 169/39 |
| 5,234,059 | A | | 8/1993 | Eynon | 169/39 |
| 5,257,827 | A | | 11/1993 | Takeuchi et al. | 169/41 |
| 5,299,645 | A | | 4/1994 | Hoening et al. | 169/39 |
| 5,447,338 | A | | 9/1995 | Kikuchi | 285/46 |
| 5,494,114 | A | | 2/1996 | Hoening et al. | 169/38 |
| 5,579,846 | A | | 12/1996 | Meyer et al. | |
| 5,664,630 | A | * | 9/1997 | Meyer et al. | 169/37 |
| 6,082,463 | A | * | 7/2000 | Ponte | 169/41 |
| 6,123,153 | A | | 9/2000 | Finnegan | 169/37 |
| 6,230,815 | B1 | | 5/2001 | Sundholm | 169/37 |
| 6,296,062 | B1 | | 10/2001 | Sundholm | 169/37 |
| 6,345,670 | B1 | | 2/2002 | Sundholm | 169/37 |
| 6,367,559 | B1 | | 4/2002 | Winebrenner | 169/37 |
| 6,520,265 | B2 | | 2/2003 | Winebrenner | |
| 6,715,561 | B2 | | 4/2004 | Franson | 169/17 |
| 6,854,668 | B2 | | 2/2005 | Wancho et al. | 239/498 |
| 7,036,603 | B2 | | 5/2006 | Thomas et al. | 169/37 |
| 7,275,603 | B2 | | 10/2007 | Polan | 169/37 |
| 7,290,618 | B2 | | 11/2007 | Thomas et al. | 169/42 |
| 7,353,882 | B2 | | 4/2008 | Pahila | 169/37 |
| 7,584,803 | B2 | | 9/2009 | Ballard | 169/40 |
| 2002/0088624 | A1 | | 7/2002 | Waligorski | 169/38 |
| 2002/0148620 | A1 | | 10/2002 | Polan | 169/38 |
| 2005/0145394 | A1 | | 7/2005 | Wancho et al. | 169/37 |
| 2009/0056958 | A1 | | 3/2009 | Polan | 169/40 |
| 2010/0212919 | A1 | | 8/2010 | Fischer | |

OTHER PUBLICATIONS

"Series LFII Residential Concealed Pendent Sprinkler, Flat Plate, 4.2 K-Factor", Tyco Fire Products, Lansdale , PA Jul. 2002; 4 pages.

* cited by examiner

LODGMENT PREVENTION ARRANGEMENTS FOR FIRE SPRINKLERS

CROSS-REFERENCE TO RELATED APPLICATION

This application is a continuation-in-part of U.S. patent application Ser. No. 11/848,103, filed Aug. 30, 2007, which is a continuation of U.S. patent application Ser. No. 10/974,106, filed Oct. 26, 2004 (now U.S. Pat. No. 7,275,603), the entire contents of which prior applications are incorporated herein by reference.

BACKGROUND OF THE INVENTION

1. Field of the Invention

This application relates to a hang-up prevention (anti-lodgment) arrangement for fire protection sprinklers. More specifically, the following disclosure addresses the prevention of lodgment of elements which are ejected from the sprinkler upon its activation. The present application also relates to a pendent fire protection sprinkler with a drop-down deflector. The present application further relates to concealed pendent sprinklers for residential, light hazard, and ordinary hazard applications.

2. Related Art

Fire protection sprinklers conventionally are connected to a conduit to receive pressurized fire-extinguishing fluid, such as water. A typical sprinkler has a base with a threaded portion for connection to the conduit and an output orifice to output the fluid to provide fire control and/or suppression. The output orifice is sealed by a seal cap, which is held in place by a release mechanism. The release mechanism is designed to release the cap under predetermined conditions, thereby initiating the flow of fire-extinguishing fluid. A typical release mechanism includes a thermally-responsive element, e.g., a frangible bulb or a fusible link, and may include a latching mechanism.

A sprinkler may be mounted on a fluid conduit running along a ceiling and may either depend downward from the conduit, which is referred to as a "pendent" configuration, or may be mounted on a wall, a certain distance below the ceiling, which is referred to as a "horizontal sidewall" configuration.

Certain conventional sprinklers have a pair of arms that extend from a base, and connect at a hub. The hub is spaced apart from the output orifice of the base and is aligned with a longitudinal axis thereof. The hub may have a set-screw configured to apply a force to the thermally-responsive element and latching mechanism thereby maintaining the seal cap in a position which seals the output orifice. A deflector may be mounted on the hub, transverse to the output orifice, to provide dispersion of the output fluid.

Other sprinklers have a deflector that is attached by a pair of arms that extend from the base of the sprinkler, but do not meet at a hub. In such sprinklers, the thermally-responsive element holds the seal cap in place without being held in compression by a hub. For example, U.S. Pat. No. 4,976,320 shows a sprinkler having a deflector attached to the body with arms that do not meet at a hub. The arms extend from the sprinkler body, and a drop-down deflector is attached to the sprinkler via two guide pins, which are installed in holes in a bent portion at the bottom of each arm. U.S. Pat. No. 5,664,630 shows another example of a sprinkler with a drop-down deflector.

Hang-up, or lodgment, is defined as a malfunction in the operation of a fire sprinkler which, when under a typical system fluid pressure, experiences the lodging of an operating part (cap, gasket, lever, strut, etc.) on or between the frame, deflector, and/or compression screw, so as to impair the water distribution for a period in excess of 60 seconds. A momentary hesitation of an operating part to clear itself from temporary contact with the frame, deflector, and/or compression screw is not considered a hang-up.

Hang-up is a condition that may cause an alteration in the spray pattern of the sprinkler. Because most sprinklers are approved for use based on their spray pattern, an altered spray pattern caused by hang-up is generally not desired.

SUMMARY

In one aspect, the present invention provides a fire protection sprinkler, including a body having an output orifice and a flange, a seal cap to seal a flow of fluid from the output orifice, and a thermally-responsive element positioned to releasably retain the seal cap. Housing members extend from the flange, and rods are slidably contained within the housing members and extend into the flange. A deflector is connected to ends of the rods.

Embodiments of the present invention may include one or more of the following features. The thermally-responsive element may include a pair of levers, each of which is connected to a plate of a soldered link. The rods may slide between a first position within the housing member, to a second, lower position extending from the housing member. In the second position, the rods may engage the housing members so as to assist in maintaining the deflector in a relatively stable position. Each of the rods may have at least one cylindrical portion and at least one frustoconical portion. Each of the housing members also may have at least one cylindrical portion and at least one frustoconical portion. The frustoconical portion of the rod may lodge in a frustoconical portion of the housing member.

The deflector may include a conical portion facing the output orifice and radial slots. At least two sides of the deflector may be substantially linear. The deflector may include tab portions with holes configured to receive ends of the rods, to connect the deflector to the rods.

Embodiments may further include a support cup having a substantially cylindrical outer surface, wherein the sprinkler is mounted in the support cup. A height of the outer surface of the support cup in an axial direction may be less than a length of the rods. A substantially cylindrical escutcheon having a flange may be installed in the support cup so as to surround the sprinkler. A substantially flat cover may be releasably mounted on the flange of the escutcheon. The deflector may move from a first position to a second, lower position upon release of the cover.

In another aspect, the present invention provides a fire protection sprinkler, including a body having an output orifice and a flange, a seal cap to seal a flow of fluid from the output orifice, and a thermally-responsive element positioned to releasably retain the seal cap. The sprinkler further includes deflector support members extending from the flange and a deflector connected to the deflector support members. In embodiments of this aspect, the deflector support members may extend through the flange.

In another aspect, the present invention provides a fire protection sprinkler, including a body having an output orifice and a flange, a seal cap to seal a flow of fluid from the output orifice, and a thermally-responsive element positioned to releasably retain the seal cap. The sprinkler further includes deflector support members having movable portions configured to move from a first position to a second position. A deflector is connected to the movable portions of the deflector support members. In the first position, the movable portions of the deflector support members are within the flange, and in the second position, the movable portions of the deflector support members are in a lower position, below the flange.

In another aspect of the invention, a fire protection sprinkler is provided comprising a body having an output orifice and a flange, and a seal cap to seal a flow of fluid from the output orifice. The sprinkler also includes a thermally-responsive element positioned to releasably retain the seal cap and constructed to separate into a plurality of portions upon exposure to a predetermined temperature. The sprinkler further includes at least one deflector support member, a deflector connected to the deflector support member; and at least one arm extending from each of the deflector support members. Each of the arms has a free end positioned in spaced relation to the thermally-responsive element to contact the portions of the thermally-responsive element upon separation thereof.

In another aspect of the invention, a fire protection sprinkler is provided that includes a body having an output orifice and a flange, a seal cap to seal a flow of fluid from the output orifice, and a thermally-responsive element positioned to releasably retain the seal cap and constructed to separate into a plurality of portions upon exposure to a predetermined temperature. The sprinkler further includes at least one deflector support member, a deflector connected to the deflector support member, and at least one interference member extending from the flange in the output direction. Each of the interference members is positioned to interfere with at least one of the portions after separation of the thermally-responsive element.

In another aspect of the invention, a concealed fire protection sprinkler is provided that includes a body having an output orifice and a flange, a seal cap to seal a flow of fluid from the output orifice, and a thermally-responsive element positioned to releasably retain the seal cap and constructed to separate into a plurality of portions upon exposure to a predetermined temperature. The sprinkler further includes at least one deflector support member, a deflector connected to the deflector support member, and a support cup. The sprinkler is mounted in an opening in a base of the support cup. The sprinkler further includes an escutcheon removably connected to an output end of the support cup. The escutcheon has a mounting flange along an edge in the output direction. The mounting flange is constructed to releasably couple to a cover. The sprinkler also includes an interference member extending from an inner surface of the escutcheon, the interference member constructed to interfere with at least one of the portions upon separation of the thermally-responsive element.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

For clarity, several figures, including FIGS. 16-19 and 21-23, show sprinklers oriented upside down.

DETAILED DESCRIPTION

Figure 1:
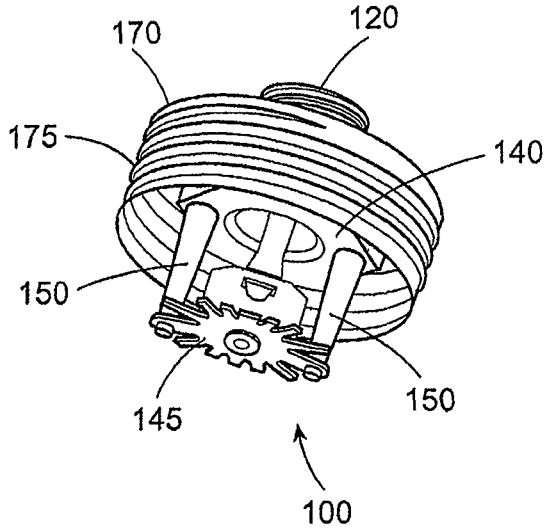
FIG. 1 is an isometric view of one embodiment of a pendent fire protection sprinkler according to the present invention.
Figure 2:
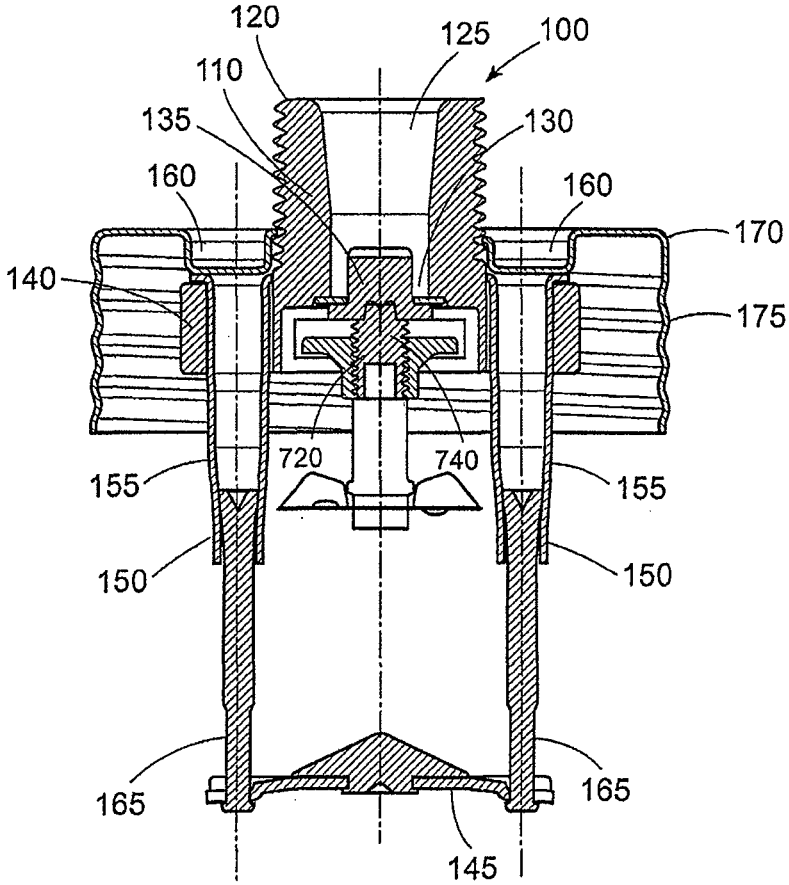
FIG. 2 is a sectional view of the sprinkler of FIG. 1, installed in the support cup, with the deflector in the deployed position.

As shown in FIGS. 1 and 2, a pendent fire protection sprinkler 100 in accordance with the present invention has a body 110 with a threaded base 120 for connection to a conduit (not shown) for supplying pressurized fire-extinguishing fluid, such as water. The body 110 has an axial bore 125 with an outlet orifice 130 from which the fluid is output upon release of a seal cap 135. The output orifice 130 may have a diameter of, for example, 5/16, 3/8, or 7/16 inch. The sprinkler may have a nominal K-factor of, for example, 3, 4.3, 4.9, 5.6, or 5.8, respectively, which is defined by $K=Q/\sqrt{p}$, where Q is the flow rate in gallons per minute and p is the residual pressure at the inlet of the sprinkler in pounds per square inch. The body 110 can have a hexagonal, rectangular, or diamond shaped flange 140 around its output end.

A deflector 145 is coupled to two deflector support members 150 on opposite sides of the sprinkler body 110. Each of the support members 150 includes a housing member 155, which extends downward from the flange 140 of the sprinkler body 110, and a rod 165, which is movable with respect to the housing member 155.

Figure 8:
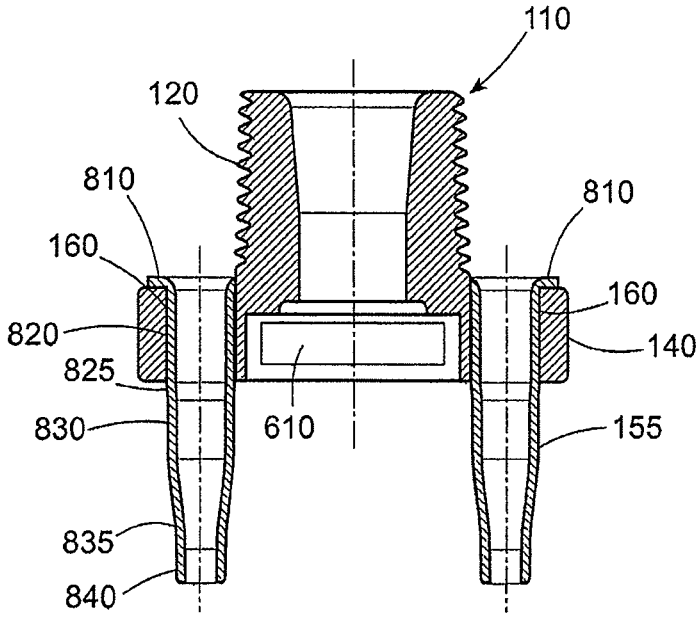
FIG. 8 is a sectional view of the sprinkler body showing the housing members of the deflector support members.
Figure 9:
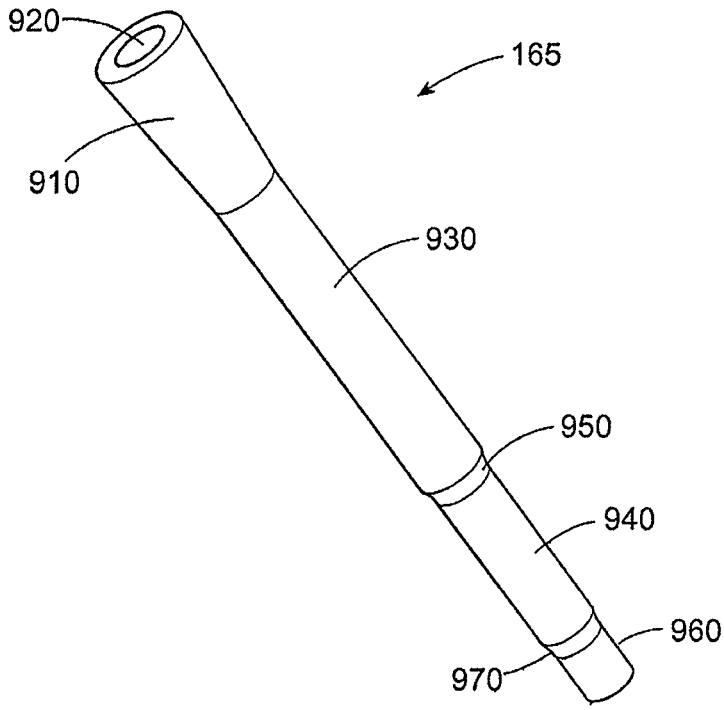
FIG. 9 is an isometric view of a rod that forms part of the deflector support member.

For example, the housing member 155 may be a tubular structure positioned within and extending downward from a hole 160 in the flange 140, and the rod 165 may be a solid, generally cylindrical member contained within the housing member 155. However, numerous other configurations for the housing members 155 and rods 165 also are possible. For example, the rods 165 may be tubular members, rather than solid members. Although the configuration of the preferred embodiment of the housing members 155 and rods 165 are shown in FIGS. 8 and 9, other shapes are possible as well, e.g., square, hexagonal, cylindrical, telescopic, etc. In addition, although in the preferred embodiment the flange 140 and housing members 155 are separate components, the present invention is not so limited, and those components may be configured as a unitary structure or having multiple components.

During operation, the rods 165 slide from an initial position, in which a large portion of the length of the rod 165 is within the housing member 155 (as shown in FIG. 1) to a deployed position, in which a substantial portion of the length of the rod 165 extends from the bottom of the housing member 155 (as shown in FIG. 2). Accordingly, in the deployed position, the deflector 145 moves downward along with the rods 165 (see FIG. 2).

The sprinkler 100 is mounted in a support cup 170 having a cylindrical, threaded outer wall 175, which surrounds a portion of the installed sprinkler 100 and, as discussed below, allows for installation into a ceiling cavity. The support cup 170 also has a mounting platform 305 (see FIG. 3) with a hole in the center into which the sprinkler body 100 is inserted. The hole has a threaded rim portion 310 or tabs configured to interlock with the threads of the sprinkler base 120.

Figure 3:
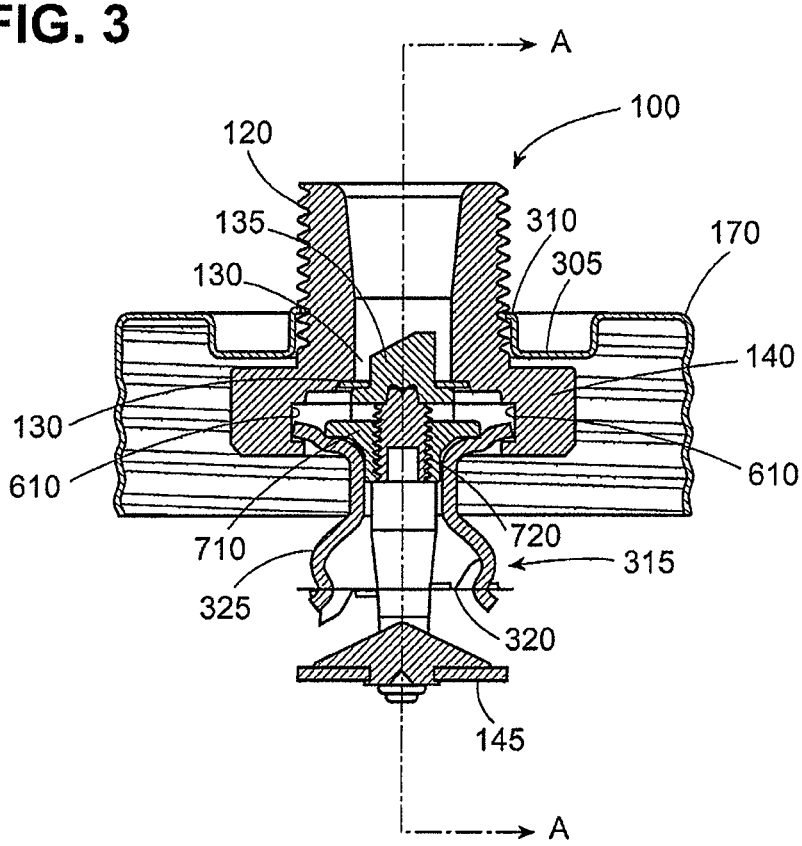
FIG. 3 is a sectional view of the sprinkler of FIG. 1, and support cup, showing the levers and fusible link.
Figure 4:
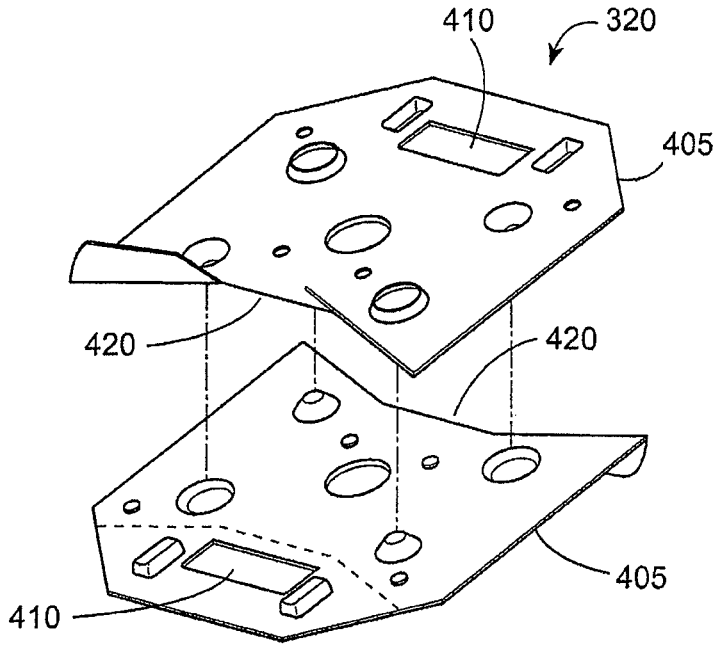
FIG. 4 is an isometric view of the fusible link.

As shown in FIG. 3, the sprinkler also has a thermally-responsive element 315 that holds the seal cap 135 in place over the output orifice 130, e.g., a fusible soldered link 320 attached to the ends of two levers 325. As shown in FIG. 4, the link 320 comprises two thin, metal plates 405, e.g., beryllium-nickel alloy. The plates 405 overlap such that a rectangular opening 410 in each plate 405, in which the ends of the levers 325 are positioned, is aligned with a slot 420 or open portion in the other plate 405. The plates 405 are attached with solder that melts at a predetermined temperature. The link 320 separates at the predetermined temperature, due to the force applied by the levers 325, allowing the levers 325 to swing outward (FIG. 3). This in turn releases the seal cap 135 and allows the fluid to be output from the orifice 130. Of course, other types of thermally-responsive elements may be used, including, but not limited to, for example, a frangible bulb and lever assembly, or a sensor, strut, and lever assembly.

Figure 5:
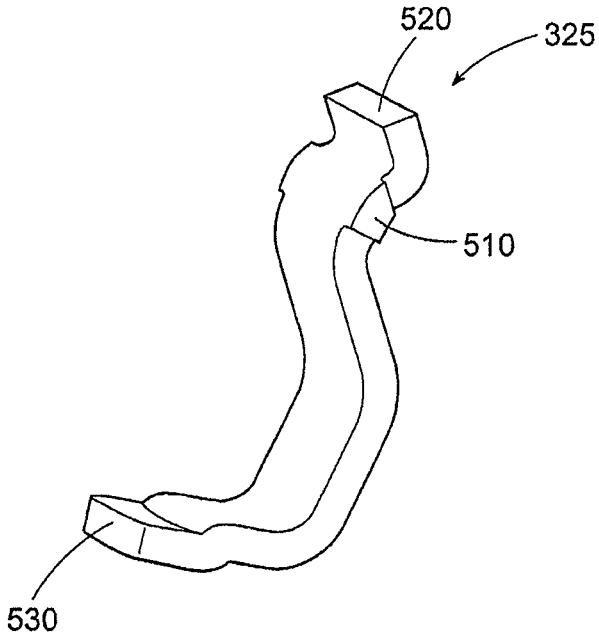
FIG. 5 is an isometric view of a lever.
Figure 6:
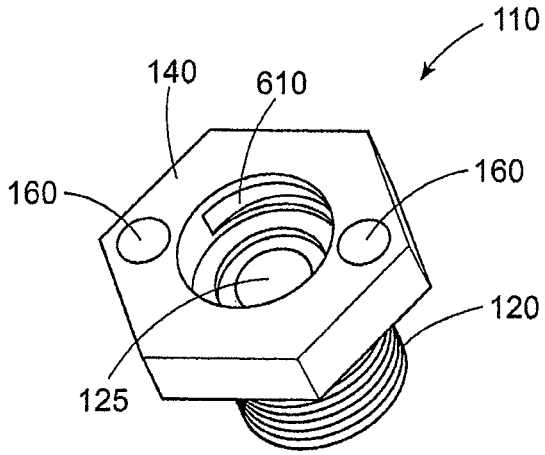
FIG. 6 is an isometric view of the underside of the sprinkler body.

Each lever, as shown in FIG. 5, is an elongated, thin, metal member, e.g., copper alloy with a thickness of 0.050 inches. Each lever 325 has a wider tab portion 510 located near the end 520 that inserts into one of the openings 410 in the link plates 405. The tab portion 510 rests against the plates 405, so as to maintain the position of the lever 325 with respect to the plates 405. The other end 530 of each lever 325 is inserted into one of a pair of arcuate, rectangular slots 610, as shown in FIG. 6, formed inside the bore 125 on either side of the outlet orifice. The slots 610 are positioned 90° apart from the deflector support members 150 in the plane of the flange 140.

Figure 7:
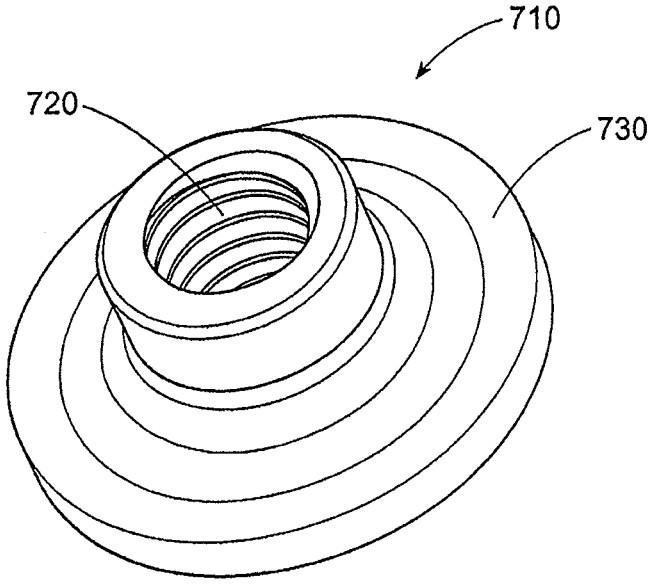
FIG. 7 is an isometric view of the load yoke.

Referring again to FIG. 3, the levers 325 swing outward upon release of the fusible link 320 due to the force of the fluid in the conduit against the seal cap 135 and a pre-tension force supplied by a loading yoke 710, as shown in FIG. 7. The loading yoke 710 is a cylindrical member with a threaded bore 720 and a circumferential flange 730 at one end. A load screw 740 (see FIG. 3) extends completely through the bore 720 of the yoke 710 and rests in an indentation in the seal cap 135. The yoke 710 is forced against the levers 325 by the tightening of the load screw 740 against the seal cap 135, thereby forcing the levers 325 away from one another.

As shown in the cross-sectional view of FIG. 8, the housing members 155 of the deflector support members 150 are positioned in through-holes 160 formed in the flange 140 of the sprinkler body 110, such that their axes are spaced apart by about 1.125 inches. Each housing member 155 is about 1.13 inches in length and is formed of thin metal, e.g., copper alloy. The top end of each housing member 155 has a flange 810 to hold it in place. The outer perimeter of this flange 810 is circular, with a cutout to allow the housing member 155 to be positioned closer to the sprinkler body 110.

At the top of each housing member 155 (i.e., the flanged end) is a first cylindrical portion 820, which is about 0.35 inches in length and about 0.26 inches in diameter. This is followed by a first frustoconical portion 825 having a length of 0.08 inches and forming an angle of about 8.0° with respect to the longitudinal axis of the housing member. A second cylindrical portion 830 adjoins, with a diameter of about 0.25 inches and a length of 0.20 inches. This is followed by a second frustoconical portion 835 having a length of 0.35 inches and forming an angle of about 8.6° with respect to the axis of the housing member. A third cylindrical portion 840 is provided at the end of the housing member 155, which has a length of about 0.11 inches and a diameter of about 0.2 inches.

As shown in FIG. 9, the rods 165 of the deflector support members 150, which slide between a position within the housing members 155 and an extended position, are each about 1.28 inches in length. Each rod 165 has a frustoconical portion 910 at the top, which is about 0.29 inches in length and forms an angle of about 4.5° with respect to the longitudinal axis of the rod. The diameter of the frustoconical portion 910 is about 0.155 inches at the top end and about 0.11 inches at the bottom end.

A conical void 920, which has a length of about 0.07 inches, an opening diameter of about 0.85 inches is formed in the end of the rod 165. The conical void 920 aids in material flow during the formation of the frustoconical portion 910 of the rod 165. The frustoconical portion 910 helps hold the rod 165 in rigid position at the bottom of the housing member 155 in the deployed position. While in the preferred embodiment the rod has a void in an end thereof, the present invention is not limited to this configuration and may include solid rods without a void or indentation, or hollow rods.

The frustoconical portion 910 is followed by a first cylindrical portion 930 of about 0.56 inches in length and a diameter of about 0.11 inches. A second cylindrical portion 940 of about 0.30 inches in length and about 0.93 inches in diameter is formed, and the top end of this portion blended to the surface of the first cylindrical portion by a curved surface 950 having a radius of 0.08 inches. A third cylindrical portion 960 having a length of about 0.115 inches and a diameter of about 0.082 inches is formed at the bottom of the rod 165. The surface of the third cylindrical portion 960 is blended to the surface of the second cylindrical portion 940 by a curved surface 970 having a radius of about 0.08 inches.

When the sprinkler is deployed (see FIG. 2), the first frustoconical portion 910 of the rod 165 lodges in the second frustoconical portion 835 and third cylindrical portion 840 of the housing member. By using the above described configuration, the deflector is more stable when deployed, allowing for a consistent sprinkler spray pattern. By contrast, without such a configuration, the force of the fluid output may cause the deflector to wobble or shift to, and possibly jam in, an askew position, resulting in an undesirable spray pattern.

The stability of this configuration is in part attributed to the resiliency in the first frustoconical portion 910 of the rod 165, which provides a substantially locking fit between the rod 165 and the housing member 155. This in turn provides stability to the deployed deflector 145 when it is exposed to the stream of output fluid, thereby preventing undesirable vibration or movement of the deflector 145. While this is the preferred embodiment, the invention is not limited to this particular configuration, and may include other deflector support members.

Figure 10:
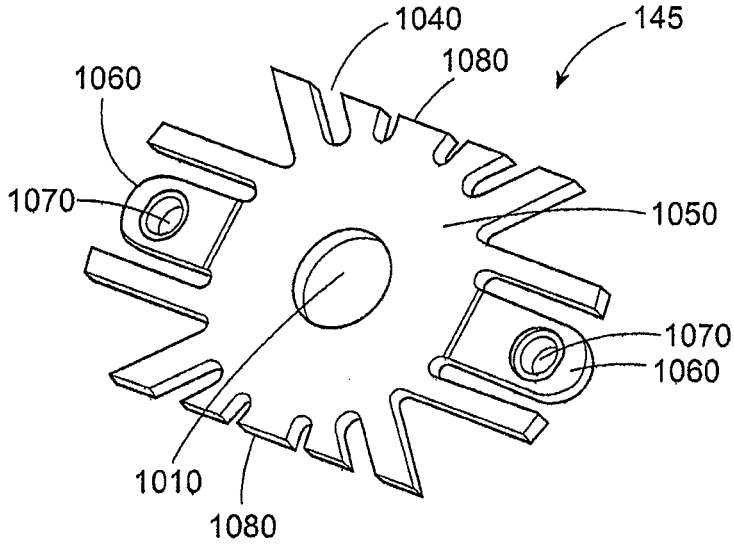
FIG. 10 is an isometric view of the deflector in the embodiment of FIG. 1.
Figure 11:
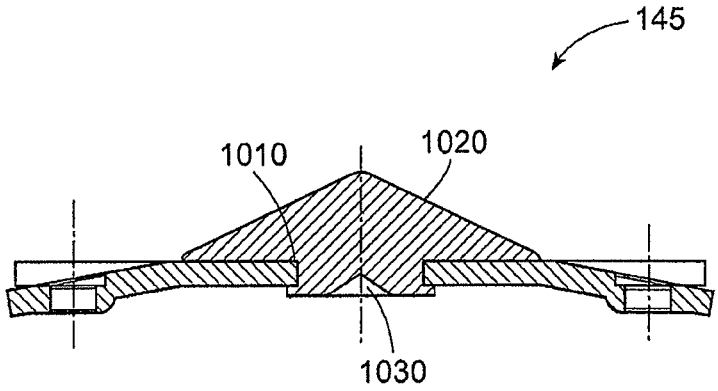
FIG. 11 is a sectional view of the deflector and the conical member.

The deflector 145, which is shown in detail in FIGS. 10 and 11, has an opening 1010 in the middle that is configured to receive a conical member 1020. The conical member 1020, which has an outer diameter of 0.7 inches and an included angle of 130°, faces the output orifice 130 to assist in the dispersion of the output fluid and to improve the stability of the deployed deflector 145. A conical indentation 1030 having an included angle of about 118° to about 120° is formed in the base of the conical member 1020 (which has a diameter of 0.245 inches) to allow it to achieve a secure press fit in the opening 1010 of the deflector 145. The conical member 1020 also helps prevent the seal cap 135 and other ejected components from becoming lodged behind the deflector 145 upon deployment of the sprinkler.

The deflector 145 has radial slots 1040 around the perimeter thereof, arrayed around the opening 1010 for the conical member 1020. The slots 1040 extend inward to within a distance of the opening 1010 to form a generally circular central portion 1050 of the deflector 145 surface. Two tab portions 1060 extend from the sides of the deflector 145 with a downward angle of about 10° (with respect to the plane of the deflector) to provide mounting holes 1070 for the rods 165 extending from the deflector support members 150. The outer edges 1080 of the other two sides of the deflector are linear (see FIG. 10).

Figure 12:
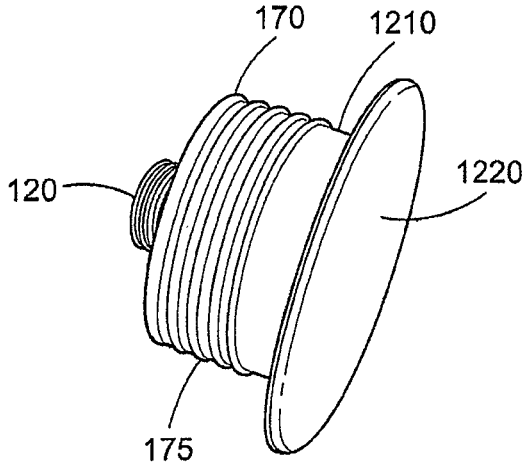
FIG. 12 is an isometric view of the sprinkler installed in the support cup, escutcheon, and cover assembly.
Figure 13:
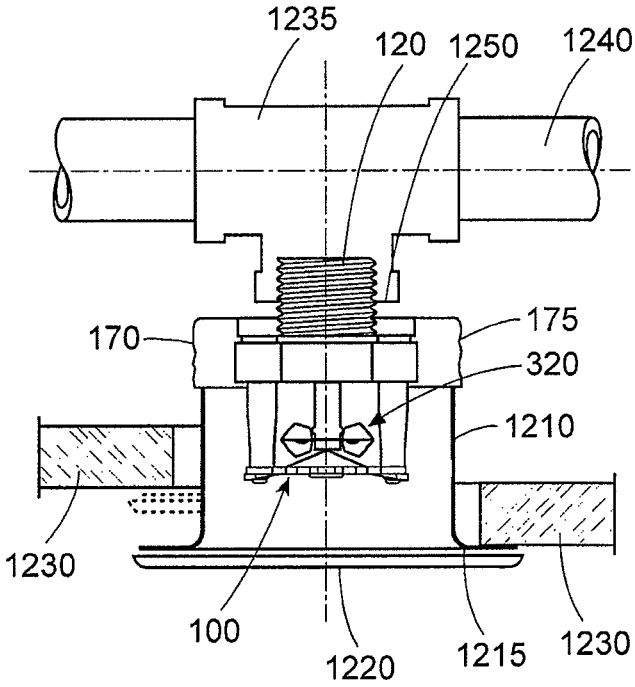
FIG. 13 is a sectional view of the sprinkler of FIG. 1 installed in a ceiling.

As shown in FIGS. 12 and 13, the sprinkler 100 installs within a support cup 170, escutcheon 1210, and cover 1220 assembly to form a concealed configuration. Such a configuration is particularly desirable for residential application due to its low profile and aesthetically pleasing appearance. The escutcheon 1210, which is cylindrical and has a circumferential flange 1215 on its outwardly facing end, installs with a press or threaded fit into the ridged outer surface (walls 175) of the support cup 170. The escutcheon 1210 is formed of metal, e.g., copper alloy.

A flat, circular cover 1220, which also is formed of metal, e.g., brass, is mounted on raised portions around the periphery of the escutcheon flange 1215 (see FIG. 13). The cover 1220 attaches to these raised portions with solder that is designed to melt at a predetermined temperature, e.g., 135° F., to allow for release of the cover 1220. The raised portions result in a gap between the cover 1220 and the escutcheon 1210, which allows air flow to reach the sprinkler 100. The release of the cover 1220 allows the deflector 145 to drop down into the deployed position. At a second predetermined temperature, e.g., 165° F., the fusible soldered link 320 separates, as described above, to initiate the flow of fluid from the sprinkler.

To install the sprinkler, the support cup 170, which has a diameter of e.g., 2.28 inches, is inserted in a cavity in the ceiling 1230 having a diameter of, e.g., about 2⅝ inches, and the threaded base 120 of the sprinkler is connected to the output fitting 1235 of a conduit 1240. The escutcheon 1210 and cover 1220 assembly is then installed in the support cup 170 so that the escutcheon flange 1215 rests on the outer surface of the ceiling 1230 (the outer surface of the cover is about 3/16 inches from the surface of the ceiling due to the gap between the flange and cover).

The support cup 170 and escutcheon 1210 are configured to allow for an adjustment to accommodate variations in the distance between the face 1250 of the conduit output fitting 1235 and the surface of the ceiling 1230, which is referred to as the "field adjustment." The field adjustment is sometimes needed, because the deflector 145 must be properly located below the ceiling 1230 in its deployed position, but it is difficult to precisely position sprinkler conduits 1240 with respect to the ceiling 1230 surface, due to the practicalities of building construction. To ensure the correct position of the deployed deflector 145, the distance between the face 1250 of the conduit output fitting 1235 and the ceiling 1230 should not be more than 2 inches.

The field adjustment is achieved by allowing the escutcheon 1210 to be positioned with a varying degree of overlap with the outer walls 175 of the support cup 170. The support cup 170 and escutcheon 1210 are configured so that any secure engagement between these components results in a proper position for the deployed deflector 145.

The amount of field adjustment, which in this example is 0.5 inches, is determined by the length of the rods 165 of the deflector support members 150, because the length of the rods 165 determines the amount of variation that can be accommodated in the position of the conduit 1240 relative to the ceiling line 1230. In other words, the rods 165 may be completely retracted within the housing member 155 before deployment, such as when the conduit 1240 and, therefore the sprinkler 100, is positioned as close as possible to the ceiling line 1230. Alternatively, the rods 165 may be nearly ¾ extended before deployment, such as when the conduit 1240 is positioned as far as possible above the ceiling line 1230. The length of the rods 165, in turn, determines the height of the outer walls 175 of the support cup 170. Thus, the outer walls 175 of the support cup 170 must have a height of slightly more than 0.5 inches in the example described herein.

Configuring the deflector support members 150 such that the rods 165 extend through the housing members 155 and the flange 140 allows for the use of a shallower cup, because the depth of the support cup is primarily determined by the length of the rods 165. This in turn results in the thermally-responsive element being located closer to the ceiling line, thereby improving sprinkler sensitivity. By contrast, in conventional concealed sprinklers, the guide pins coupled to the deflector are generally positioned below the flange, thereby requiring a deeper support cup (because the depth of the support cup is determined by the length of the guide pins plus the flange thickness). Consequently, the thermally-responsive element is located farther from the ceiling line, resulting in reduced sprinkler sensitivity.

To address some of the problems of lodgment in fire protection sprinklers, in one aspect of the invention a sprinkler is provided which includes a structure for guiding and absorbing the energy of dissociating releasable sprinkler components upon activation thereof during a fire condition prior to those dissociating components contacting the deflector. Specifically, these designs can be used in conjunction with the sprinkler described above with respect to FIGS. 1-13 to contact the ejected metal plates 405 of the link 320 shown in FIGS. 3 and 4. Of course the various embodiments described hereinbelow can also be used with other types of thermal release members other than the link 320, such as, for example, glass bulbs, and lever/strut assemblies.

Figure 14:
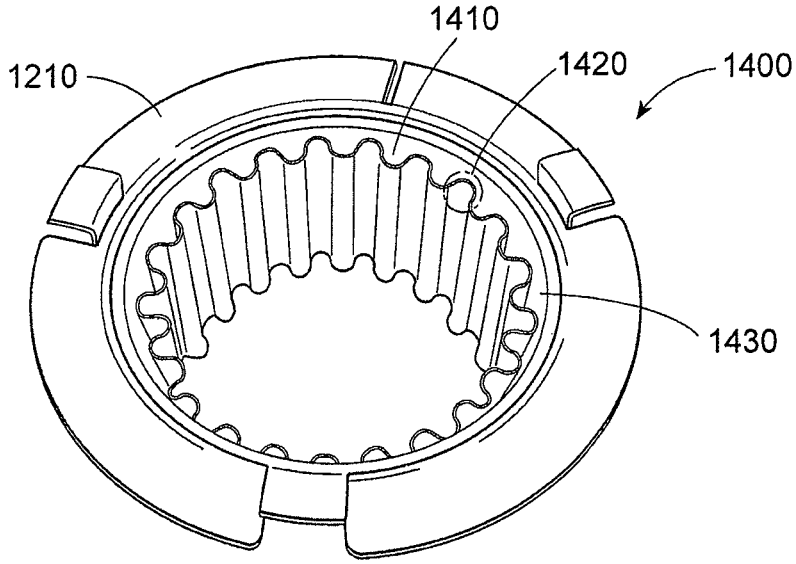
FIG. 14 is an isometric view from one side of an escutcheon assembly that includes a corrugated insert.

In another aspect of the invention an anti-hang up arrangement for a sprinkler is provided that includes an escutcheon assembly 1400 as shown in FIG. 14, comprised of the escutcheon 1210 of FIG. 12 and a corrugated insert 1410 attached to an inner surface of the escutcheon 1210. The escutcheon assembly 1400 is constructed to substitute for the escutcheon 1210 shown in FIG. 12 used in the sprinkler/escutcheon/cover assembly. The insert 1410 can be a separately formed component which is attached to the escutcheon 1210 by various methods, such as by press fit and solder.

The corrugated insert 1410 is arranged as a ring which is coaxial with the escutcheon 1210. The corrugated insert 1410 is formed from a generally cylindrically-shaped thin foil sleeve that engages the concealed sprinkler's escutcheon. The thickness of the corrugated insert 1410 is between 0.005 inch and 0.020 inch. The sleeve includes a plurality of corrugations 1420 which extend radially inwardly a predetermined distance from the inner surface of the escutcheon. The height of the corrugations are equal, as are the width of the corrugations. The height of the corrugations is between about 0.70 inch and about 1.00 inch and the width of the corrugations is between about 0.03 inch and 0.10 inch.

As discussed above with respect to the fusible soldered link 320 of the sprinkler 100 shown in FIGS. 2 and 3, when the solder between the two metal blades 405 fuses prior to sprinkler activation, the blades 405 separate and fly apart. In an embodiment where the escutcheon assembly 1400 is substituted for the escutcheon 1210 of FIG. 13, the separated blades 405 are set free to impact the corrugations 1420 in the sleeve 1410. Upon impact with the corrugations 1420 in the sleeve 1410, the corrugations 1420 dampen the energy of the blades 405, thus preventing one or both of the released blades 405 from aggressively bouncing off the interior surface of the support sleeve 1410. As a result of their reduced energy, the blades 405 have less momentum and therefore are less likely to bounce off of the sleeve 1410 and lodge in portions of the deflector, such as slots 1040, which could affect a desired spray pattern.

Figure 15:
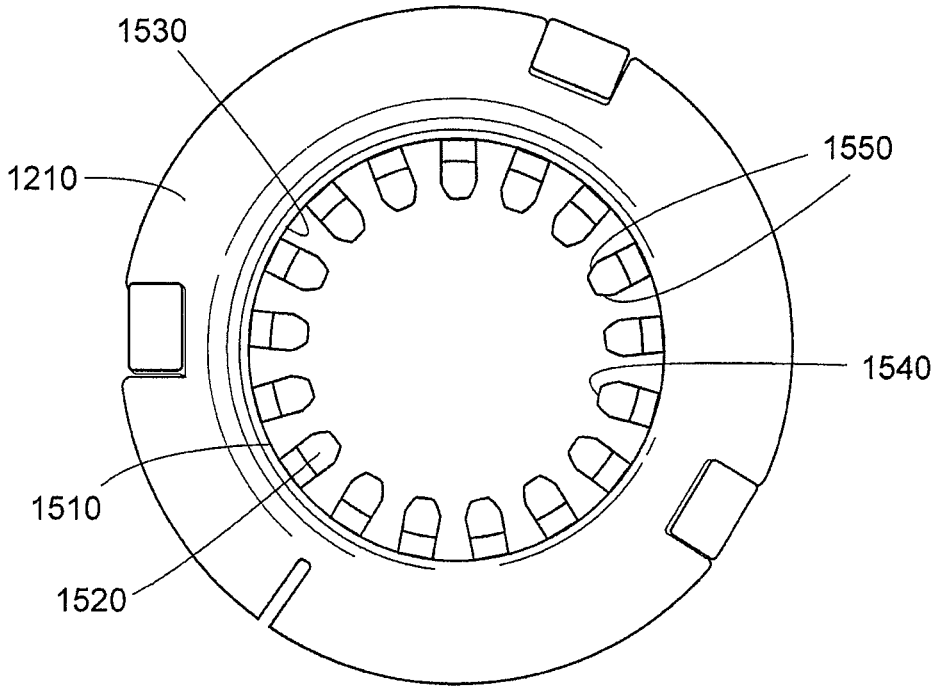
FIG. 15 shows an elevation view of another embodiment of an escutcheon assembly with an alternate insert.

An alternative arrangement to the corrugated sleeve 1410 of FIG. 14 is shown in FIG. 15, which includes an annular ring 1510 having specifically located tines 1520 extending radially inward. In the embodiment shown in FIG. 15, a plurality of tines 1520 are equally spaced around the interior surface 1530 of the ring 1510. Each of the tines 1520 is formed as a planar surface substantially perpendicular to the inner surface 1530 of the ring 1510. Each tine 1520 is generally formed in the shape of a rectangle having a free end 1540 extending radially inwardly. The free end 1540 includes chamfered corners 1550 such that the tine has a profile approximating the profile of the corrugations 1420 in FIG. 14. The ring 1510 is configured to be affixed in the escutcheon 1210, such as by a press fit arrangement of the ring 1510 into the escutcheon 1210 or by soldering the ring 1510 to the inner surface of the escutcheon 1210. In the assembled state shown in FIG. 15, the tines 1520 are oriented perpendicular to the inner wall 1430 of the escutcheon 1210. The tines 1520 function similarly to the corrugations 1420 of FIG. 14 in damping the energy of the metal blades 405 upon their separation from the a fusible soldered link 320.

The convolutions 1420 of FIG. 14 and the tines 1520 of FIG. 15 are constructed so that they are spaced from and do not directly contact the soldered sensor 320. This is done in order to avoid the possibility of a cold sink condition, whereby heat generated by a fire could be conducted from the fusible soldered link 320 to any structure(s) directly in contact with that fusible soldered link 320, thus potentially reducing the sensitivity of the fusible soldered link 320, and prolonging the separation time of the fusible soldered link 320 and the activation time of the sprinkler 100.

Figure 16:
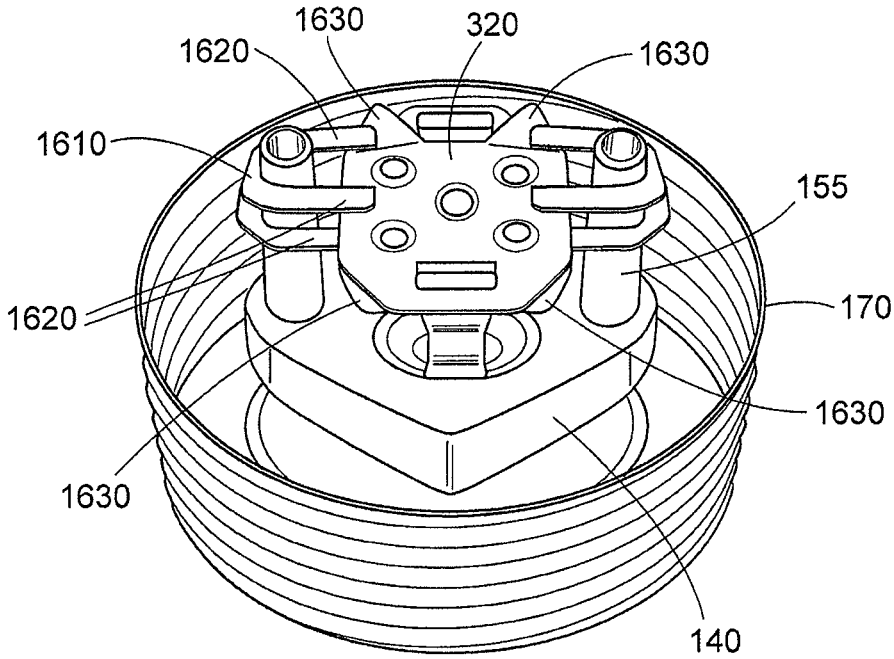
FIG. 16 is an isometric view of a hang-up prevention arrangement for a sprinkler in accordance with another embodiment of the invention.

FIG. 16 shows a portion of the sprinkler 100 shown in FIG. 1 with the deflector 145 and the rods 165 removed for clarity of illustration and shows a pair of motion limiter clips 1610 attached to the housings members 155 of the deflector support members 150. In this arrangement, each clip 1610 is attached directly to each of the housings 155. The clip 1610 can be formed of a stamped metal or molded plastic, for example. The clip 1610 contains two sets of trip blades 1620, a first set located above the link 320, and a second set located below the link 320. Both sets of trip blades 1620 are aligned perpendicular to the releasing direction of the activated metal blades 405 of the link 320. The trip blades 1620 are constructed to interfere with the motion of the separated metal blades 405 of the link 320 upon the fusing of the solder of the link 30. Specifically, the clips 1620 are designed to contact heat fins 1630 of the moving metal blades 405 to reduce the separation velocity of those metal blades 405. In the assembled condition shown in FIG. 16, each clip 1610 is spaced from the link 320 so as to avoid making direct contact with any part of the link 320 so as to avoid the possibility of a cold sink condition, discussed hereinabove in connection with the description of FIGS. 14 and 15.

Figure 17:
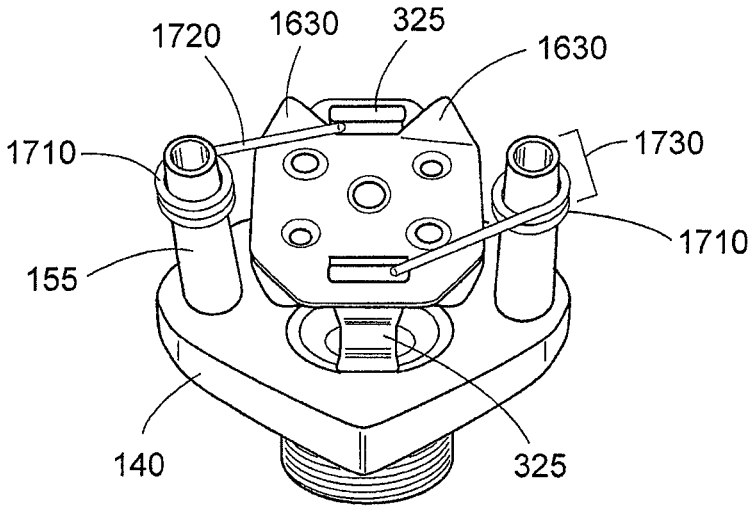
FIG. 17 is an isometric view of another hang-up prevention arrangement for a sprinkler in accordance with another aspect of the invention.

In another exemplary embodiment shown in FIG. 17, a pair of opposed trip springs 1710 are attached to the housing members 155 of the sprinkler shown in FIGS. 1 and 8. The trip springs 1710 are coiled around each of the housing members 155 and each spring 1710 has a flexible arm 1720 extending from a coiled portion 1730 in a direction that is substantially transverse to the release direction of the metal blades 405 of the link 320. The trip springs 1710 can be formed from a metal, such as stainless steel wire. Upon the separation of the metal blades 405 when the solder of link 320 fuses, the fins 1630 of the moving metal blades 405 come into contact with at least the arms 1720. The arms 1720 are resilient to act as flexible shock absorbers to deflect the upper metal blade 405 as well as the separating levers 325 of the release mechanism. It should be noted that the trip springs 1710 may extend from a position on the housing member 155 that is closer to the flange 140 of the sprinkler 100 in order to change the trip springs 1710 interference with the levers 325. In the embodiment shown in FIG. 17, the arms 1720 of the trip springs 1710 are intentionally spaced above the upper blade 405 of the link 320 at a predetermined elevation so as to interfere with the heat fins 1630 of the upper metal blade 405 while avoiding direct contact with the link 320 in the assembled state. The trip spring 1710 is not limited to being formed from a round wire fabrication process, but could use a flat spring strip, or leaf spring, for example, which could be installed onto the housing members 155 during assembly.

Figure 18:
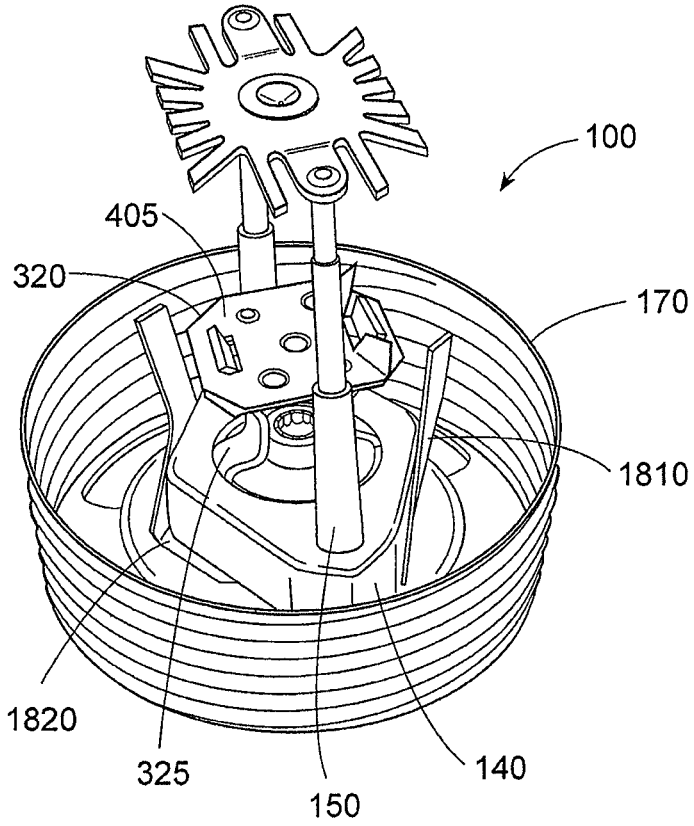
FIG. 18 is an isometric view of a sprinkler constructed with a hang-up prevention bracket.
Figure 19:
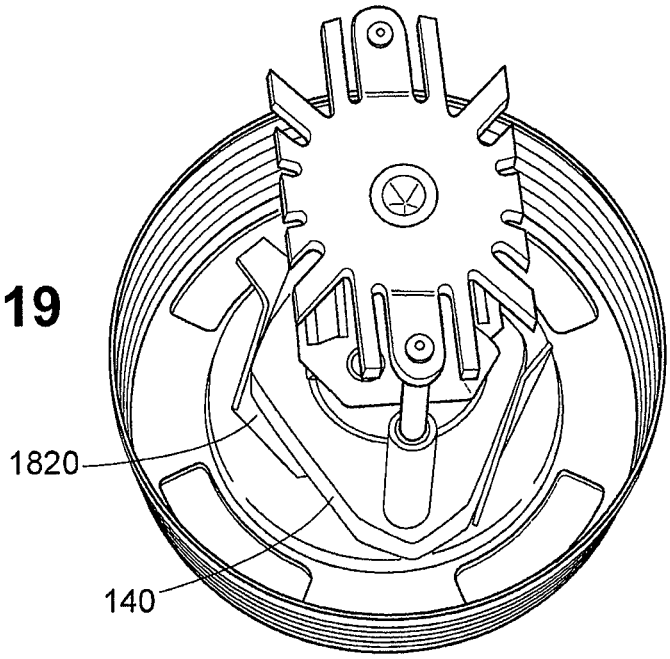
FIG. 19 is another isometric view of the sprinkler of FIG. 18 viewed from above the deflector of the sprinkler.

In another embodiment, shown in FIGS. 18 and 19, the sprinkler 100 shown in FIG. 1 is shown which includes a generally U-shaped bracket 1810 (FIG. 20) which is attached between the concealed sprinkler 100 and its support cup 170. The sprinkler 100 of FIG. 18, while shown sharing many of the same features as that shown in FIG. 1, differs in the shape of the flange 140 from that shown in FIG. 6. The flange 140 shown in FIG. 18 has a generally diamond shaped profile, whereas the flange 140 shown in FIG. 1 has a hexagonal shaped profile. The bracket 1810 can be formed from a metal or a plastic, including at least one of brass, stainless steel, and urea plastic. Where the bracket 1810 is formed of a metal, the bracket is stamped from a metal having properties that are complimentary with the body of the sprinkler. For example, the bracket is formed of a material, which, in contact with its environment, will not cause corrosion. In one embodiment, the bracket 1810 is stamped from a copper alloy strip.

Figure 20:
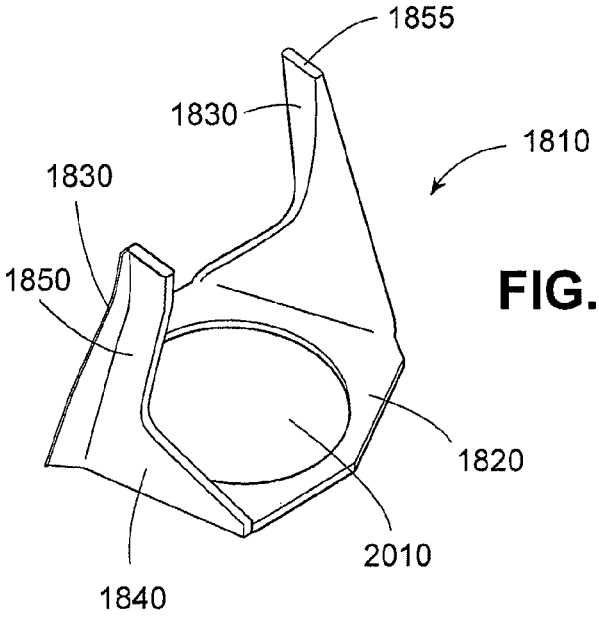
FIG. 20 is an isometric view of the bracket in FIGS. 18 and 19.

The bracket 1810 is shown in greater detail in FIG. 20. The bracket 1810 is formed having a substantially planar base 1820 and a pair of arms 1830 extending from the base 1820 in the output direction. The base defines an opening 2010 through which the threaded connection 120 of the sprinkler 100 can pass so as to permit the retention of the base 1820 between the flange 140 of the sprinkler 100 and the mounting platform 305 (FIG. 3) of the support cup 170. By virtue of retaining the bracket 1810 between the flange 140 and the mounting platform 305, the connection of the bracket 1810 can be made resistant to vibration. Such vibration resistant connection facilitates a reduction in vibration induced stress and, consequently, stress-induced corrosion on the bracket 1810.

Beginning at the base 1820, the arms 1830 of the bracket 1810 have a generally triangular shaped portion 1840 extending from the base 1820 of the bracket 1810 becoming narrower in the output direction. The triangular end portion 1840 extends to an elongated portion 1850 having a generally rectangular shape. The elongated portion 1850 has a free end 1855 in the output direction. The triangular portions 1840 extend parallel to each other and parallel to a set of oppositely facing surfaces of the flange 140 (FIGS. 18 and 19) of the sprinkler 100. The two triangular portions 1840 facilitate the alignment of the bracket 1810 with the sprinkler body during assembly so that the arms 1830 of the bracket 1810 lie in a plane that is oblique with a plane passing through the deflector support members 150. In particular, the two triangular portions 1840 are constructed to permit self-alignment with the flange 140 of the sprinkler 100 and, in turn, the deflector support members 150.

The arms 1830 are also skewed or twisted a predetermined angle with respect to an axis through their longitudinal direction. The skew angle of the arms 1830 imparts enhanced counter-clockwise redirection to the moving blades 405 upon the activation of link 320.

Each of the free ends 1855 of the arms 1830 is disposed about 0.25 inches from the centerline of the deflector support members 150. Disposing the leading edge 0.25 inches from the deflector support members 150 provides an unobstructed release of the levers 325 upon separation of the blades 405 of the link 320. The free ends 1855 of the arms 1830 are also approximately 3/16 inch shorter in the output direction than the housing members 150, providing an approximate gap of 1 1/8 inches between the underside of the deflector 145 in its fully deployed position (FIGS. 18 and 19) and the free end 1855 of each of the arms 1830. The elongated portion 1850 of the arm is approximately 0.15 inches wide and the radially inner surface of the elongated portion is spaced at least 1/8 inches from the outer edges of the link 320.

Figure 21:
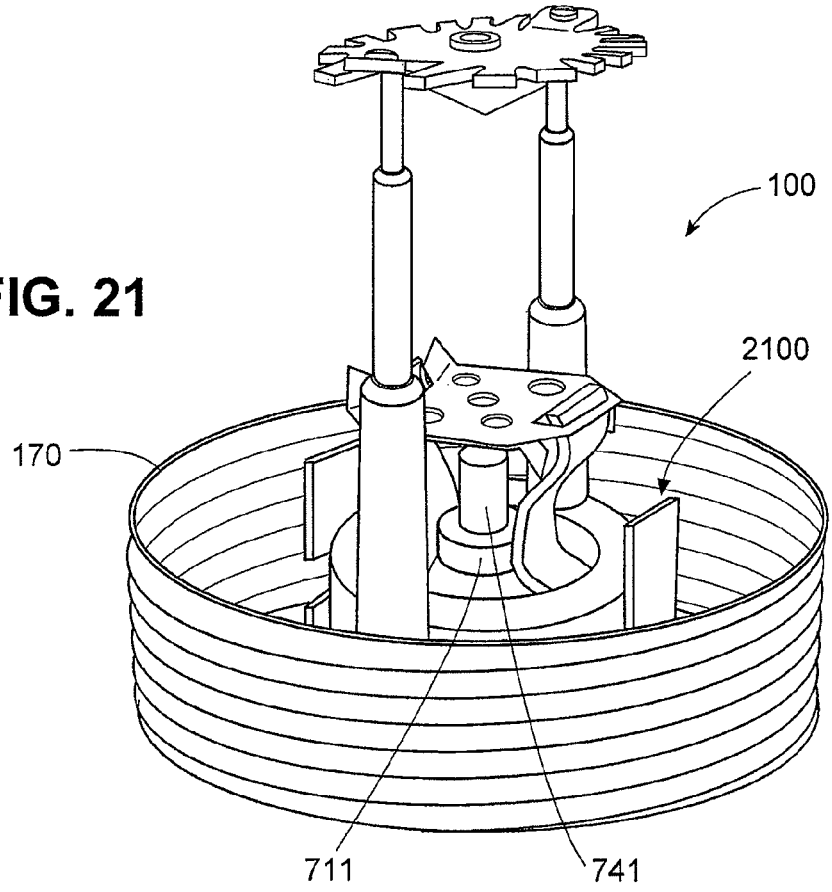
FIG. 21 is an isometric view of a sprinkler constructed with another hang-up prevention bracket in accordance with another aspect of the invention.
Figure 22:
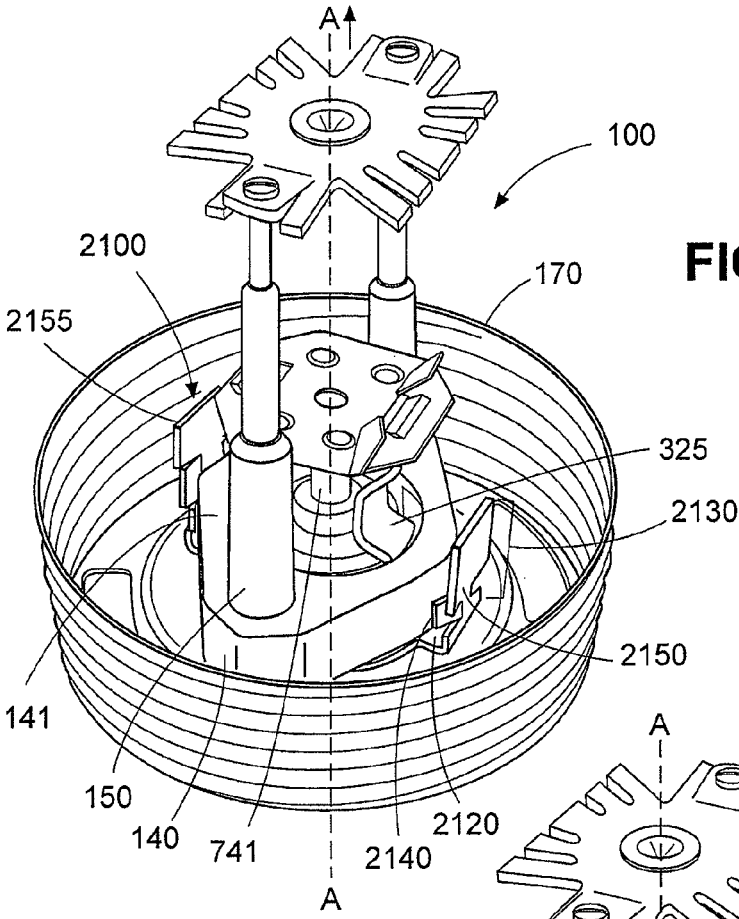
FIG. 22 is another isometric view of the sprinkler of FIG. 21 from a higher elevation than in FIG. 21.

Another embodiment of a sprinkler arrangement similar to that shown in FIGS. 18 and 19 is shown in FIGS. 21 and 22 with an alternate bracket 2100 retained between the sprinkler 100 shown in FIGS. 18 and 19 and the cup 170. As in FIGS. 18 and 19 the flange 140 of the sprinkler 100 shown in FIGS. 21 and 22 is diamond shaped. In the embodiment shown in FIGS. 21 and 22, the bracket 2100 has a base 2120 constructed like that shown in FIG. 20 and has arms 2130 that are generally rectangular that extend in the output direction. The arms 2130 lie in a plane that is perpendicular to a plane passing through the deflector support members 150 of the sprinkler 100. Each arm 2130 extends in a plane that is parallel with the plane passing through the deflector support members 150.

As shown in FIG. 22, a lower portion of each bracket arm 2130 includes two retaining fins 2140 which extend at an angle with respect to the plane of the upper portion 2150 of the bracket arm 2130. The retaining fins 2140 straddle the apex 141 formed in the flange 140 of the body of the sprinkler 100. The apex 141 is formed between the deflector support members 140. The angle between the retaining fins 2140 is complimentary to the angle formed at the apex 141 of the flange 140. The retaining fins 2140 facilitate the alignment of the bracket 2100 with respect to the sprinkler flange 140, and thus alignment of the bracket arms 2130 with respect to the rest of the components of the sprinkler 100. Specifically, by virtue of the alignment of the retaining fins 2140 with the flange 140, the bracket arms 2130 are accurately positioned in a plane that is perpendicular to a plane passing through the deflector support members 150, and the arms 2130 lie in a plane passing through the levers 325. Thus, the arms 2130 are positioned to be in the path of the ejected levers 325 upon fusing of the metal plates 405 of the link 320. Upon fusing of the solder in the link 320, each lever 325 will tend to rotate away from the sprinkler axis A-A (FIG. 22) toward a free end 2155 of an upper portion 2150 of one of the arms 2130 and subsequently come into contact with the free end 2155, thereby dampening the energy of the metal plates 405 and the ejected levers 325.

The arms 2130 extend in the output direction, denoted by the arrow in FIG. 22, an amount sufficient to contact at least one of the levers 325 and the metal plate 405 of the link 320 upon activation of the sprinkler 100.

In the embodiment shown in FIGS. 21 and 22, the load screw 741 is longer than the load screw 740 shown in FIGS. 2 and 3. Upon sprinkler activation the load screw 741 and its attached yoke 711 tend to move axially in the output direction towards the conical surface 1020 of the deflector 145. In the case of the embodiment shown in FIGS. 21 and 22, the elongated load screw 740 projects further in the output direction than the load screw 740 shown in FIG. 3. As a result, when the load screw 741 and the yoke 711 are ejected during sprinkler activation, the load screw 741 impinges upon the conical surface 1020 (FIG. 11) which creates a fulcrum for the load screw 741. The longer load screw 741, has a longer lever arm than load screw 740. Accordingly, upon impingement of issuing fluid, the load screw 741 has increased instability about the conical surface 1020 as compared to load screw 740. Moreover, the yoke 711, being positioned further from the conical surface 1020 upon impingement of the load screw 741 increases the torque acting about the end of the load screw 741 contacting the conical surface 1020. As a result of the increased instability of the load screw 741, the load screw 741 tends to rotate on the conical surface 1020 away from the axis A-A and is ejected from the sprinkler 100 with a reduced likelihood of lodging in portions of the deflector 145, such as slots 1040.

Figure 23:
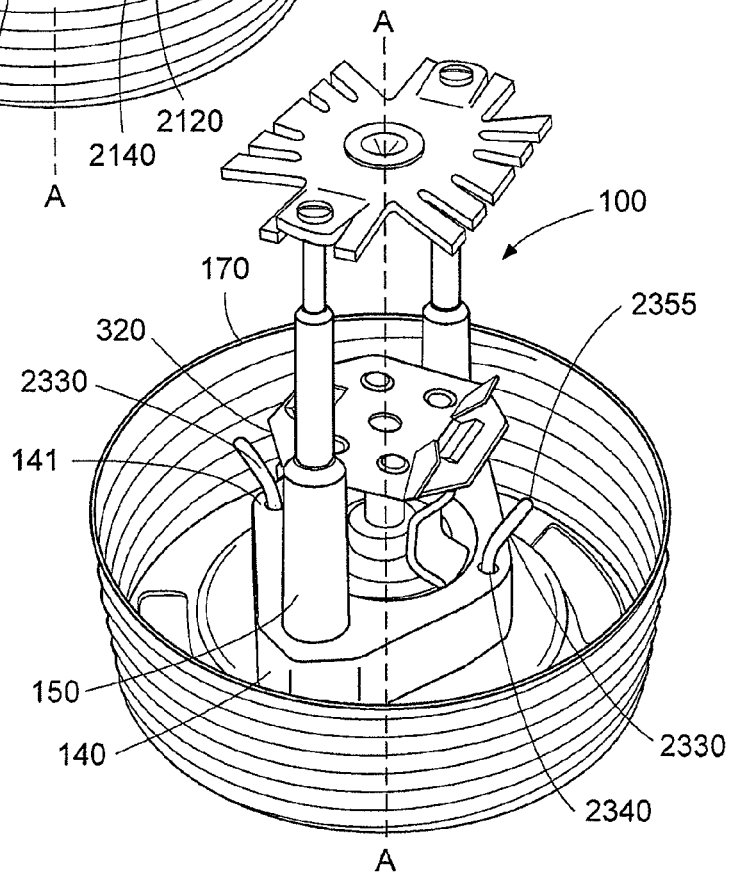
FIG. 23 is an isometric view of a sprinkler constructed with a pin extending from a flange of the sprinkler body.

Another embodiment of an anti-hang up arrangement for a sprinkler is shown in FIG. 23. The sprinkler 100 is constructed as shown in FIGS. 18, 19, 21 and 22, except that the flange 140 includes a pair of pins 2330 that are diametrically opposite each other and extend from the flange 140 generally in the output direction indicated by the arrow. Each pin 2330 extends from the apex 141 of the flange 140 located between the two deflector support members 150.

The pins 2330 extend in the output direction the same distance as the arms 2130 discussed above in connection with the embodiment shown in FIGS. 21 and 22. The two pins lie in a plane that passes through the levers 325 and the pins 2330 curve away from the axis A-A.

The pins 2330 can be formed of a metal. In one embodiment, the pins 2330 are constructed having a threaded end 2140 that is threaded into mating threads of a hole 2145 formed in the flange 140. In another embodiment, the pins

2330 are formed by casting them with the flange of the sprinkler so as to make the pins and the flange 140 a unitary structure. It will be appreciated that casting the pins 2330 to the flange 140 ordinarily reduces manufacturing costs.

As shown in FIG. 23, the pins 2330 are positioned to be in the path of the ejected levers 325 upon fusing of the metal plates 405 of the link 320 during activation of the sprinkler 100. Upon fusing of the solder in the link 320, each lever 325 will tend to rotate away from the sprinkler axis A-A (FIG. 23) toward a free end 2355 of a pin 2330 and subsequently come into contact with the free end 2355, thereby dampening the energy of the metal plates 405 and the ejected levers 325.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

Therefore, while the invention has been shown and described with respect to example embodiments thereof, it will be understood by those skilled in the art that changes in form and details may be made to these embodiments without departing from the scope and spirit of the invention.

What is claimed is:

1. A fire protection sprinkler, comprising:

a body having an output orifice and a flange;

a seal cap to seal a flow of fluid from the output orifice;

a thermally-responsive element positioned to releasably retain the seal cap and constructed to separate into a plurality of portions upon exposure to a predetermined temperature;

at least one deflector support member;

a deflector connected to the deflector support member; and at least one interference member extending from the flange in the output direction, wherein each of the interference member(s) is positioned to interfere with at least one of the portions after separation of the thermally-responsive element, wherein the interference member(s) include two arms that extend in a plane that is substantially parallel to a facing surface of the flange.

2. The fire protection sprinkler according to claim 1, wherein the deflector support members comprise a plurality of housing members extending from the flange in the output direction and a plurality of rods, each rod slidably contained within one of the housing members and extending into the flange.

3. The fire protection sprinkler according to claim 1, wherein the interference member(s) include a base, the arms extending in an output direction from the base, wherein the base and the arms are constructed to receive and align with the flange.

4. The fire protection sprinkler according to claim 3, wherein the arms extend the output direction at least as far as the position of the thermally responsive element.

5. The fire protection sprinkler according to claim 1, wherein each arm is skewed along its axis, whereby the arms are skewed to effect a counter-clockwise rotation of the portions of the thermally responsive element upon separation thereof.

6. The fire protection sprinkler according to claim 4, wherein the two arms lie in a plane that is oblique to a plane passing through the deflector support members.

7. The fire protection sprinkler according to claim 3, wherein the arms include a pair of retaining fins that form a surface that aligns with a surface of the flange.

8. The fire protection sprinkler according to claim 7, wherein the arms lie in a plane that is perpendicular to a plane passing through the deflector support members.

9. The fire protection sprinkler according to claim 7, wherein the arms extend in the output direction less than the distance between the thermally responsive element and the flange.

* * * * *